US005080142A

United States Patent [19]

Calamito et al.

[11] Patent Number: 5,080,142

[45] Date of Patent: Jan. 14, 1992

[54] INTEGRALLY WOVEN MULTI-APERTURED MULTI-LAYER ANGLE INTERLOCK FABRICS

[75] Inventors: Dominic P. Calamito, Hermosa Beach; Richard H. Pusch, Huntington Beach, both of Calif.

[73] Assignee: HITCO, Gardena, Calif.

[21] Appl. No.: 334,684

[22] Filed: Apr. 6, 1989

[51] Int. Cl.[5] ..... B32B 3/12; D03D 1/00; D03D 11/02

[52] U.S. Cl. ..... 139/384 R; 139/387 R; 139/410; 139/411; 428/101; 428/166; 428/257

[58] Field of Search ..... 428/101, 166, 257; 139/384 R, 410, 411, 387 R

[56] References Cited

U.S. PATENT DOCUMENTS

| | | | |
|---|---|---|---|
| 2,164,848 | 7/1939 | Wallin | 139/411 |
| 3,048,198 | 8/1962 | Koppelman et al. | 139/410 |
| 3,090,406 | 5/1963 | Koppelman et al. | 139/410 |
| 3,234,972 | 2/1966 | Koppelman et al. | 139/410 |
| 3,575,776 | 4/1971 | McIntyre | 139/410 |
| 3,749,138 | 7/1973 | Rheaume et al. . | |
| 3,943,980 | 3/1976 | Rheaume | 139/410 |
| 4,312,913 | 6/1982 | Rheaume | 428/257 |
| 4,922,968 | 5/1990 | Bottger et al. | 139/384 R |
| 4,958,663 | 9/1990 | Miller et al. | 139/384 R |
| 5,021,283 | 6/1991 | Takenaka et al. | 139/384 R |

*Primary Examiner*—James C. Cannon

*Attorney, Agent, or Firm*—Larry W. Evans; Joseph G. Curatolo; Sue E. Phillips

[57] ABSTRACT

An integrally woven multi-apertured multi-ply angle interlock fabric is woven so as to have a plurality of apertures which extend across the width of the fabric and are completely contained within the thickness of the fabric. The fabric is comprised of a first yarn system in which yarns extending across the width of the fabric in parallel, spaced-apart fashion form a laminate of spaced-apart, generally parallel yarn layers between the opposite top and bottom surfaces. The fabric is also comprised of a second yarn system having weaver yarns arranged into yarn layers which repeatedly extend through portions of the thickness of the fabric between the top and bottom surfaces and which interweave with a plurality of the yarn layers of the frist yarn system on one side of and one or more yarn layers of the first yarn system on the other side of the plurality of apertures being formed within the thickness of the fabric.

16 Claims, 3 Drawing Sheets

INTEGRALLY WOVEN MULTI-APERTURED MULTI-LAYER ANGLE INTERLOCK FABRICS

BACKGROUND OF THE INVENTION

1. Field of the Invention

The present invention relates to integrally woven multi-layer angle interlock fabrics, and more particularly to such fabrics which are woven so as to have a plurality of apertures within the thickness thereof extending along the width or length thereof.

2. History of the Prior Art

It is known in the art of integrally woven multilayer materials to weave a fabric from a plurality of different yarn systems which provide the fabric with multiple interwoven layers or plies of thickness. Fabrics of this type are illustrated by U.S. Pat. No. 3,749,138 of Rheaume et al., which patent issued Jul. 31, 1973 and is commonly assigned with the present application. The Rheaume et al. patent describes the weaving of a multi-layer fabric which is comprised of angled warp yarns extending through the thickness of the fabric and interwoven with fill yarns which extend across the width of the fabric in an orientation generally parallel to one another and to the opposite broad surfaces of the fabric and perpendicular to the warp yarns. A third or stuffer yarn system may be present such that generally parallel stuffer yarns extend along the length of the fabric in orientations perpendicular to the fill yarns.

Further examples of multi-layer woven fabrics are provided by U.S. Pat. No. 4,312,913 of Rheaume, which patent issued Jan. 26, 1982. The Rheaume patent illustrates fabric produced by an angle weave in which lengths of fill yarn disposed in a nominally parallel configuration are interwoven with angled warp yarns. The warp yarns extend in a zig-zag configuration through the thickness of the fabric between the opposite broad surfaces thereof so as to form a succession of intersecting warp sheets or layers. The warp sheets intersect with and form acute angles with the opposite broad surfaces of the woven fabric and with yarn layers formed by the fill yarns.

The multi-layer woven fabrics described in U.S. Pat. No. 3,749,138 of Rheaume et al. and U.S. Pat. No. 4,312,913 of Rheaume are typical of woven angled fabrics in which the warp yarn system extends through the entire thickness of the fabric to provide an integral, tightly woven multi-layer fabric having generally uniform properties throughout the thickness thereof. Such configurations are advantageous for many applications calling for multi-layer fabrics with good structural and other properties. Such fabrics have formed the basic configurations from which special fabric configurations have been designed for special applications. For example, the woven fabrics can be impregnated with a resin system which, when cured, results in a relatively rigid structural member of desired shape and having particular properties with respect to such things as strength, thermal conductivity, and electrical conductivity. Such fabrics have been woven so as to have partial slots within the opposite side surfaces thereof. The partial slots define opposite flaps in the fabric which provide the fabric with an I-beam configuration upon impregnation and curing.

Rigid structures can also be formed using such woven fabrics in other kinds of matrixes. For example, the fabric can be formed of and/or combined with matrices such as ceramics, glass, carbon, or metal in forming a rigid matrix having desired properties.

Further examples of integrally woven multi-layer angle interlock fabrics are provided by copending application Ser. No. 07/232,450 (now U.S. Pat. No. 4,958,663) of Miller et al., "WOVEN MULTI-LAYER ANGLE INTERLOCK FABRICS AND METHODS OF MAKING SAME", which application was filed Aug. 15, 1988 and is commonly assigned with the present application. The Miller et al. application describes a fabric woven so as to have a slot within the thickness thereof and extending along the length of the fabric. Because the fabrics described in that application are woven so that the warp yarns extend along the fabric in generally parallel, spaced-apart yarn layers or plies with the fill yarns extending through the thickness of the fabric between the opposite broad surfaces thereof in repeating fashion and interweaving with the war yarns, the fabric can be of virtually unlimited length or width as well as having advantageous structural properties in the length or width direction.

In spite of the variety of weaving techniques and configurations which have heretofore been used in the formation of integrally woven multi-layer angle interlock fabrics, such fabrics have been lacking in situations where it is desired to form a hollow, multi-apertured fabric having a plurality of interwoven layers on one or both sides of the apertures. An integrally woven multi-apertured multi-layer fabric would be especially advantageous, not only in terms of providing such fabrics with substantial thickness where desired, but also in terms of being able to incorporate desired strength and conductivity properties into the woven fabric. Heretofore, fabrics used in the formation of hollow, multi-apertured structures have been limited to non-multi-layer configurations in which a single layer of fabric extends between opposite single layers forming face sheets. Where one or both of the face sheets are built up into multiple layered configurations, the multiple layers are not interwoven with other portions of the fabric including the layers interconnecting the opposite face sheets, so that an integrally woven multi-layer fabric is not provided.

SUMMARY OF THE INVENTION

Fabrics in accordance with the invention comprise integrally woven multi-layer angle interlock fabrics having one or more pluralities of apertures formed therein in a desired configuration. The fabrics are woven so that the yarns of a second yarn system thereof which are interwoven with the multiple yarn layers of a first yarn system alternately extend between the opposite sides of a plurality of apertures formed thereby within the fabric. In such fabrics the yarns of the second or weaver yarn system are interwoven with a plurality of different yarn layers of the first yarn system on one side of the plurality of apertures and with one or more yarn layers on the other side of the apertures. The yarns are configured so that the plural apertures extend across the width or along the length of the fabric and are completely contained within the cross-sectional elevation of the fabric between opposite top and bottom surfaces and opposite end surfaces for the fabric. With at least some, and typically most or all, of the apertures completely contained within the fabric thickness so as to be spaced apart from the top, bottom and end surfaces defining the perimeter of the cross-sectional elevation, a multi-apertured fabric of the integrally woven multi-layered variety is provided.

Conventional nomenclature usually defines fabric length as being the dimension of the fabric in the warp direction and fabric width as being the dimension of the fabric in the fill direction. As described hereafter fabrics in accordance with the invention can be formed so that the first yarn system is comprised of fill yarns and the second yarn system is comprised of warp yarns, or vice versa. Accordingly, terms such as length and width as used herein should be understood to be interchangeable, depending on the manner of weaving used to form the various yarn systems.

Fabrics in accordance with the invention have a width (transverse dimension) defined by the widths of the opposite top and bottom surfaces and the widths of the opposite end surfaces. The opposite top and bottom surfaces and the end surfaces define the cross-sectional elevation of the fabric, which elevation is typically uniform across the width of the fabric. Each of the apertures formed within the fabric by the weaving process extends across the width of the fabric, and most if not all of the apertures are completely contained within the cross-sectional elevation such that they are spaced apart from the perimeter of the cross-sectional elevation formed by the top, bottom and opposite end surfaces. Typically, the apertures are spaced apart across the cross-sectional elevation, and may comprise slots lying within a common plane extending across a length (longitudinal dimension) of the fabric between the opposite end surfaces and parallel to the top and bottom surfaces.

In one embodiment of a fabric in accordance with the invention, a single row of spaced-apart slots is formed across the cross-sectional elevation of the fabric during the weaving thereof. One yarn system of the fabric forms a plurality of yarn layers above the slots and a plurality of yarn layers below the slots. A second or weaver yarn system of the fabric includes yarns interwoven with the plural yarn layers of the first yarn system both above and below the slots. Some of the weaver yarns extend through and interweave with the plural yarn layers of the first yarn system above one of the slots, then extend into the lower portion of the fabric where they interweave with the plural yarn layers below the adjacent slot. Other ones of the weaver yarns extend from beneath the first slot to above the adjacent slot. In this manner the weaver yarns extend through the thickness of the fabric in a crisscross configuration so as to form the spaced apart slots within the fabric thickness while at the same time interweaving with all of the yarn layers of the first yarn system.

A fabric having a plurality of slots and woven in the manner just described can be transformed into a generally hollow, multi-apertured structural member by impregnation with a resin or other matrix forming system. Insertion of cylindrical mandrels into the slots during the impregnation results in an integrally woven multi-layer fabric comprised of a plurality of generally cylindrical portions spaced apart from and parallel to one another and having cylindrical interiors therein. Adjacent ones of the cylindrical portions are joined by connecting portions of the fabric which lie within a common plane.

In a second embodiment of a fabric woven in accordance with the invention, the fabric is provided with two different pluralities of spaced apart apertures within the thickness thereof. The apertures of the second plurality are offset from and staggered relative to the first plurality of apertures, and comprise spaced apart slots lying within a second common plane parallel to and spaced apart from a first common plane in which the slots comprising the first plurality of apertures lie. A first yarn system forms plural yarn layers on the opposite sides of the common planes of the two different pluralities of slots. The weaver yarns of a second yarn system are divided into three different groups, with the yarns of the first group extending both above and below the lower plurality of slots and the yarns of the third group being completely contained within the plurality of yarn layers of the first yarn system above the upper or second plurality of slots. The second group of weaver yarns extends between and joins the portion of the fabric above the upper or second plurality of apertures to the remainder of the fabric and helps to form the upper or second plurality of apertures in the process.

A fabric woven so as to have two different pluralities of slots in the thickness thereof as just described can be transformed into a generally hollow multi-apertured structural member by combination with a resin or other matrix forming system. Mandrels are inserted into the apertures during combination with the matrix forming system to provide the fabric with a desired shape. Insertion of cylindrical mandrels into the lower plurality of apertures provides the fabric with a succession of hollow cylindrical portions joined together by connecting portions, much in the manner previously described in connection with the fabric having a single plurality of apertures. However, the presence of the upper second plurality of apertures enables the formation of a thin, generally planar portion of the fabric disposed above and joining each of the cylindrical portions. Such thin planar portion is spaced apart from the connecting portions of the fabric between the hollow cylindrical portions.

BRIEF DESCRIPTION OF THE DRAWINGS

A better understanding of the invention may be had by reference to the following description, taken in conjunction with the accompanying drawings in which.

DETAILED DESCRIPTION OF THE INVENTION

Figure 1:
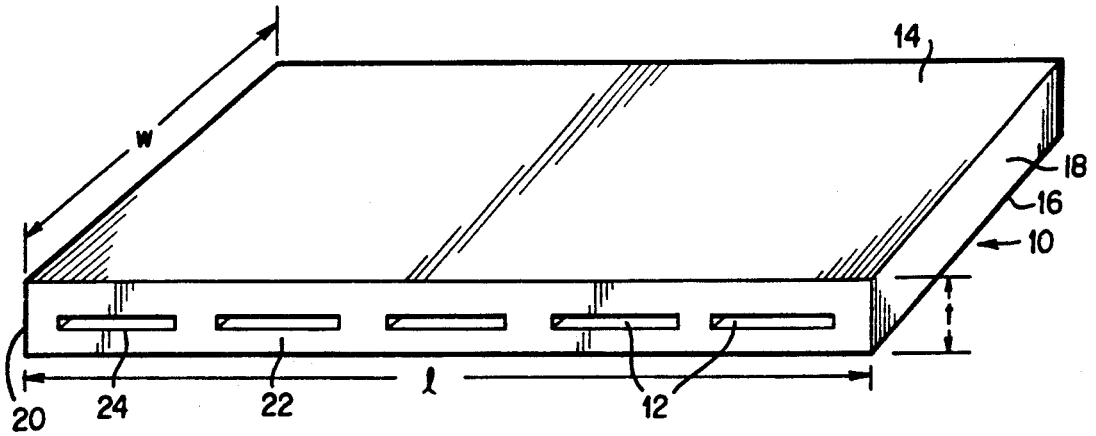
FIG. 1 is a perspective view of an integrally woven multi-apertured multi-layer angle interlock fabric in accordance with the invention, having a single plurality of apertures therein.

FIG. 1 shows an integrally woven multi-apertured multi-layer angle interlock fabric 10 in accordance with the invention. The fabric 10 of FIG. 1 has a plurality of apertures 12 formed within the thickness thereof and extending across the width "w" of the fabric 10. The width "w" of the fabric 10 is defined by the widths of opposite top and bottom surfaces 14 and 16 and by the widths of opposite end surfaces 18 and 20. The fabric 10 has a length "l" defined by the distance between the opposite end surfaces 18 and 20. The fabric has a thickness "t" defined by the distance between the opposite top and bottom surfaces 14 and 16. The top and bottom surfaces 14 and 16 and the opposite end surfaces 18 and 20 lie along the perimeter of and define a cross-sectional elevation 22 of the fabric 10. The cross-sectional elevation 22 is generally uniform throughout the width "w" of the fabric 10.

As previously noted, the terms width (w) and length (l) are used for convenience of illustrating the examples described herein. The terms are interchangeable inasmuch as the first and second yarn systems forming the fabrics such as the fabric 10 of FIG. 1 can comprise fill and warp yarns respectively, or vice versa, as described hereafter.

In accordance with the invention a plurality of the apertures 12 are completely contained within the cross-sectional elevation 22 of the fabric 10. In the example of FIG. 1, all of the apertures 12 are completely contained within the cross-sectional elevation 22 so as to be spaced apart from the perimeter thereof as defined by the opposite top and bottom surfaces 14 and 16 and the opposite end surfaces 18 and 20.

In the example of FIG. 1, the apertures 12 comprise slots 24 which are spaced apart along the length "l" so as to lie within a common plane extending along the fabric length "l" so as to be spaced apart from and parallel to the top and bottom surfaces 14 and 16.

Figure 2:
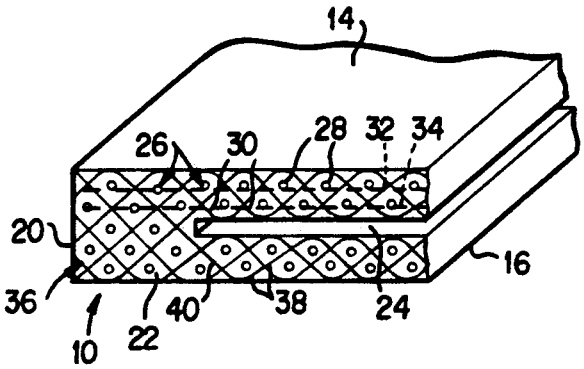
FIG. 2 is a close-up perspective view of a portion of the fabric of FIG. 1 illustrating the manner in which the fabric is formed by two different yarn systems.

FIG. 2 is a close-up view of a portion of the fabric 10 of FIG. 1, illustrating the woven composition of the fabric 10. The fabric 10 is comprised of a first yarn system 26 including a plurality of yarns 28 which are arranged in a plurality of spaced-apart generally parallel yarn layers 30. The locations of two of the yarn layers 30 which are disposed above the slot 24 in the fabric 10 are illustrated by dotted lines 32 and 34 in FIG. 2. The yarn layers 30 formed by the first yarn system 26 are arranged into a laminate of such yarn layers between the opposite top and bottom surfaces 14 and 16. The individual yarns 28 forming the yarn layers 30 extend in generally parallel, spaced-apart relation across the width "w" of the fabric.

As shown in FIG. 2 the fabric 10 also includes a second yarn system 36 comprised of a plurality of weaver yarns 38. The weaver yarns 38 are formed into a plurality of yarn layers 40 which repeatedly extend through at least a portion of the thickness "t" of the fabric 10 between the opposite top and bottom surfaces 14 and 16. The yarn layers 40 form acute angles with the yarn layers 30 as they repeatedly extend through part or all of the thickness "t" of the fabric 10.

In accordance with the invention the yarn layers 40 are interwoven with each of a plurality of the yarn layers 30 on one side of the slot 24 as well as with at least one yarn layer 30 on the opposite side of the slot 24. In the example of FIG. 2 in which there are five of the yarn layers 30 between the opposite top and bottom surfaces 14 and 16, two of which are disposed above the slot 24 as indicated by the dotted lines 32 and 34, another two of which are disposed beneath the slot 24, and an intermediate one of which is disposed in the plane of the slot 24. The yarn layers 40 extend through each of the five yarn layers 30 so that the weaver yarns 38 therein are interwoven with the yarns 28 in each of the five yarn layers 30.

The first yarn system 26 can comprise fill yarns with the weaver yarns 38 of the second yarn system 36 being provided by the warp yarns of a conventional loom. Alternatively, the fabric 10 can be woven using the weaving technique described in the previously referred to copending application Ser. No. 07/232,450 of Miller et al., in which event the first yarn system 26 is provided by warp yarns and the weaver yarns 38 of the second yarn system 36 are provided by the fill yarns of a conventional loom.

Figure 3:
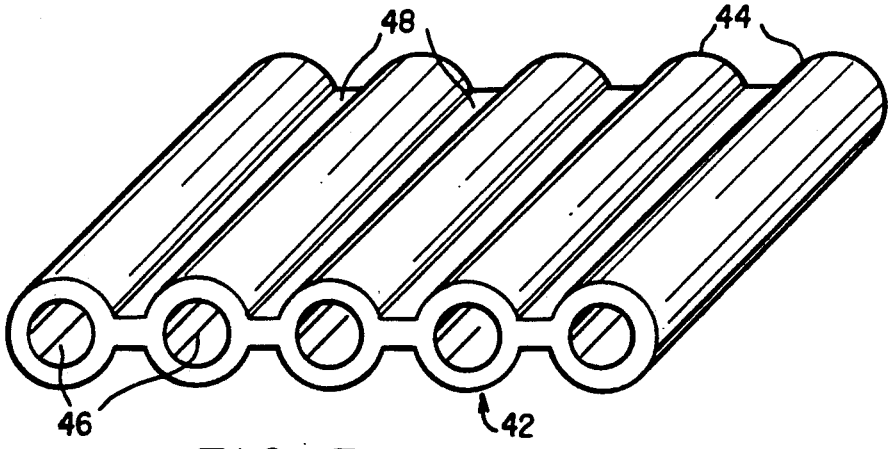
FIG. 3 is a perspective view of a generally hollow, multi-apertured structural member which may be formed from the fabric of FIG. 1 through combination with a matrix forming system.

The fabric 10 of FIG. 1 can be transformed into a generally hollow, multi-apertured structural member 42 shown in FIG. 3 through introduction of a matrix forming substance such as resin impregnation followed by curing. Cylindrical mandrels inserted within the slots 24 cause the fabric 10 to assume the shape of the structural member 42 shown in FIG. 3. The fabric 10 is impregnated with the matrix forming substance which is rigidified to form the rigid structural member 42. The cylindrical mandrels are removed following curing, forming a plurality of generally cylindrical portions 44 with cylindrical apertures 46 therein. The generally cylindrical portions 44 are of elongated configuration and are spaced apart and generally parallel to each other along the length of the structural member 42. Each adjacent pair of the generally cylindrical portions 44 are joined by a different connecting portion 48 of the structural member 42, such that the various connecting portions 48 lie within a common plane extending across the width of the structural member 42.

Figure 4:
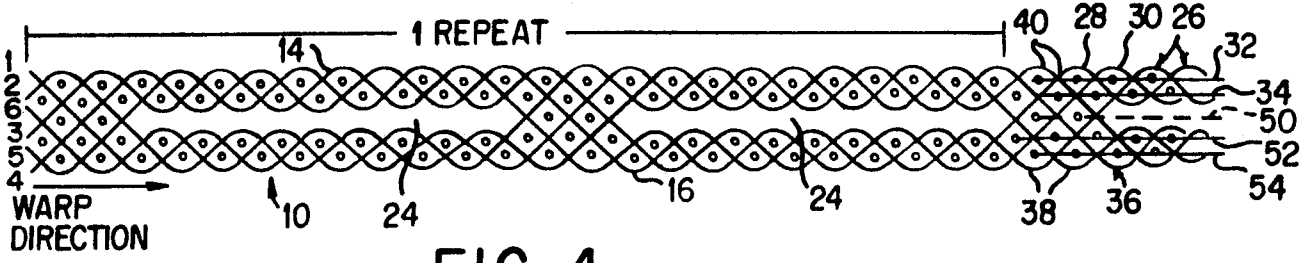
FIG. 4 is a schematic view in cross-sectional elevation of a portion of the fabric of FIG. 1 illustrating the details of the weave thereof.

FIG. 4 illustrates in detail the manner in which the fabric 10 is woven, in the present example. As shown in FIG. 4 the first yarn system 26, which in the present example comprises the fill yarns, includes five different yarn layers 30. In addition to the top two layers represented by the dotted lines 32 and 34, there is an intermediate layer represented by a dotted line 50 and two lower layers represented by dotted lines 52 and 54. The second yarn system 36 is comprised of the weaver yarns 38, which in the present example comprise warp yarns forming the yarn layers 40. The warp direction is shown in FIG. 4.

FIG. 4 shows one repeat of the fabric 10 which includes two of the slots 24. The fabric 10 can be woven using a conventional loom. Where a fly shuttle loom is used, the warp yarns 38 are selectively raised and lowered by harnesses while the fill yarns 28 are laid in place by the loom shuttle. Each of the fill yarns 28 comprises a different pick of the repeat. There are 100 picks in the repeat, as shown.

As shown in FIG. 4 the warp yarns 38 of the second yarn system 36 are arranged into six different ones of the yarn layers 40 which are numbered 1–6 at the left side of FIG. 4. It will be seen that each of the six different warp yarn layers 40 extends through the entire thickness of the fabric 10 at each region of the fabric width "w" between an adjacent pair of the slots 24. In those regions where warp layers 1, 2 and 6 extend from the top surface 14 to the bottom surface 16 of the fabric 10, the other three warp layers 3, 5 and 4 extend in the opposite direction from the bottom surface 16 to the top surface 14. At the next region between adjacent slots 24, the warp planes reverse in direction. Accordingly, if the warp planes 1, 2 and 6 extend from the top surface 14 to the bottom surface 16 at one region between slots 24, then those same warp planes extend from the bottom surface 16 to the top surface 14 at the next region between an adjacent pair of the slots 24. In this manner the warp layers 40 alternate by being disposed above one slot 24 and then crossing over to be disposed below the next slot 24. The warp layers 40 are divided into opposite groups which extend in an alternating, out-of-phase manner so that a crisscrossing effect is achieved.

Figure 5:
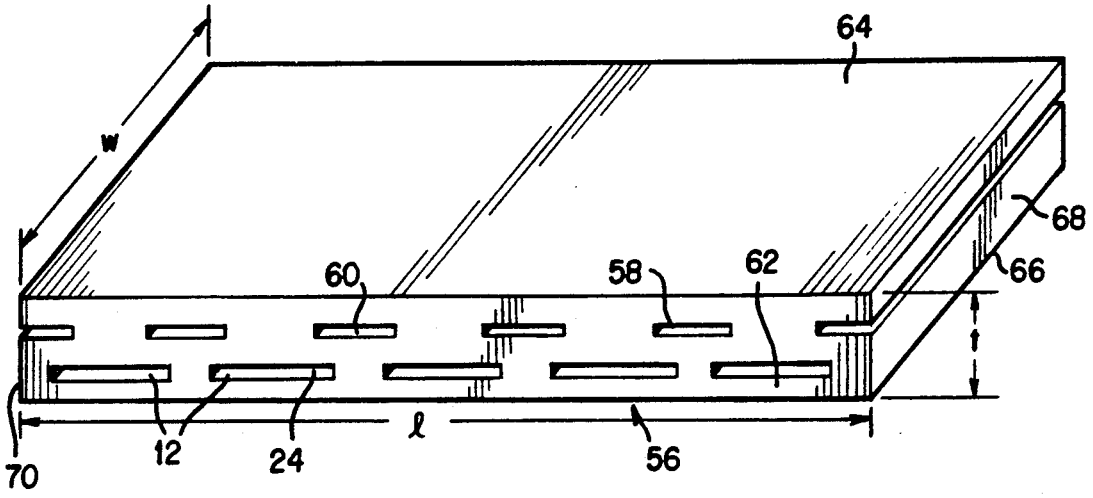
FIG. 5 is a perspective view of an alternative embodiment of an integrally woven multi-apertured multi-layer angle interlock fabric in accordance with the invention, having two different pluralities of apertures therein.

An alternative arrangement of an integrally woven multi-apertured multi-ply angle interlock fabric 56 is shown in FIG. 5. The fabric 56 of FIG. 5 is similar to the fabric 10 of FIG. 1 except that the thickness "t" thereof is slightly greater in order to accommodate the presence of a second plurality of apertures 58 in addition to the first plurality of apertures 12. In the example of FIG. 5 the second plurality of apertures 58 comprise a series of spaced apart slots 60 lying within a common plane spaced apart from and generally parallel to the common plane of the slots 24 comprising the first plurality of apertures 12. In addition, the slots 60 are staggered relative to the slots 24. In the particular example of FIG. 5, four of the slots 60 are completely contained within a cross-sectional elevation 62 so as to be spaced apart from the perimeter of the cross-sectional elevation 62 defined by opposite top and bottom surfaces 64 and 66 and opposite end surfaces 68 and 70. Two of the slots 60 at opposite ends of the fabric open onto the opposite end surfaces 68 and 70. The slots 60 extend along the entire width "w" of the fabric 56 as do the slots 24. The cross-sectional elevation 62 is generally uniform along the entire width "w" of the fabric 56.

Figure 6:
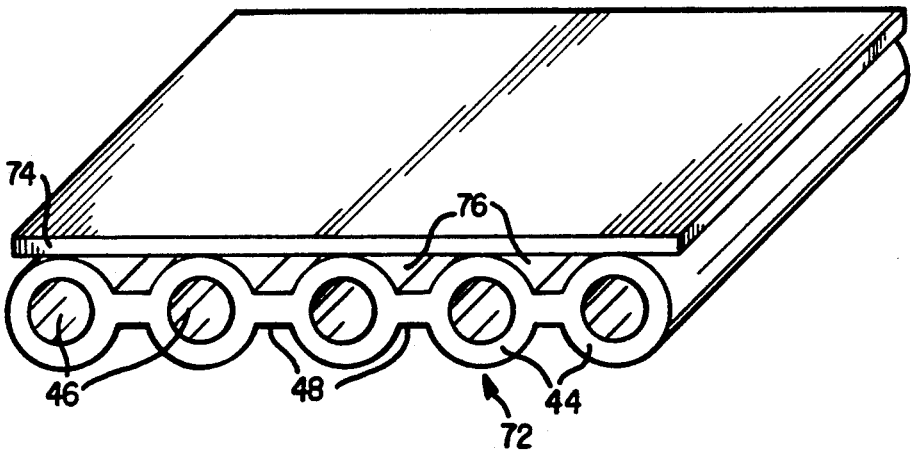
FIG. 6 is a perspective view of a generally hollow, multi-apertured structural member which may be formed from the fabric of FIG. 5 through combination with a matrix forming system.

FIG. 6 shows a generally hollow multi-apertured structural member 72 which may be formed from the fabric 56 of FIG. 5 through the addition of a matrix forming substance. Generally cylindrical mandrels are inserted in the slots 24 comprising the first plurality of apertures 12 in the fabric 56. Mandrels of generally triangular-shaped cross-section are inserted in the slots 60 comprising the second plurality of apertures 58 in the fabric 56. The mandrels are allowed to remain in the fabric 56 during rigidizing of the matrix forming substance such as curing of a thermosetting resin system following impregnation of the fabric 56 with the resin system. The mandrels are then removed, producing the rigid structural member 72 shown in FIG. 6.

As shown in FIG. 6 the structural member 72 includes a plurality of the generally cylindrical portions 44 extending along the length of the structural member 72 and being generally parallel to and spaced apart from each other. The generally cylindrical mandrels produce the cylindrical apertures 46 within the generally cylindrical portions 44. As in the case of the structural member 42 of FIG. 3, the structural member 72 of FIG. 6 is provided with a plurality of the connecting portions 44 which generally lie within a common plane extending across the width of the structural member 72. Each of the connecting portions 48 extends between and joins together a different adjacent pair of the generally cylindrical portions 44.

The structural member 72 of FIG. 6 is like the structural member 42 of FIG. 3 except for the presence of a thin planar portion 74 disposed at the side of the structural member 72 and joining each of the generally cylindrical portions 44. The thin planar portion 74 forms a plurality of apertures 76 together with the connecting portions 48 and adjacent parts of the generally cylindrical portions 44. The apertures 76 are formed by the mandrels of generally triangular-shaped cross-section.

Figure 7:
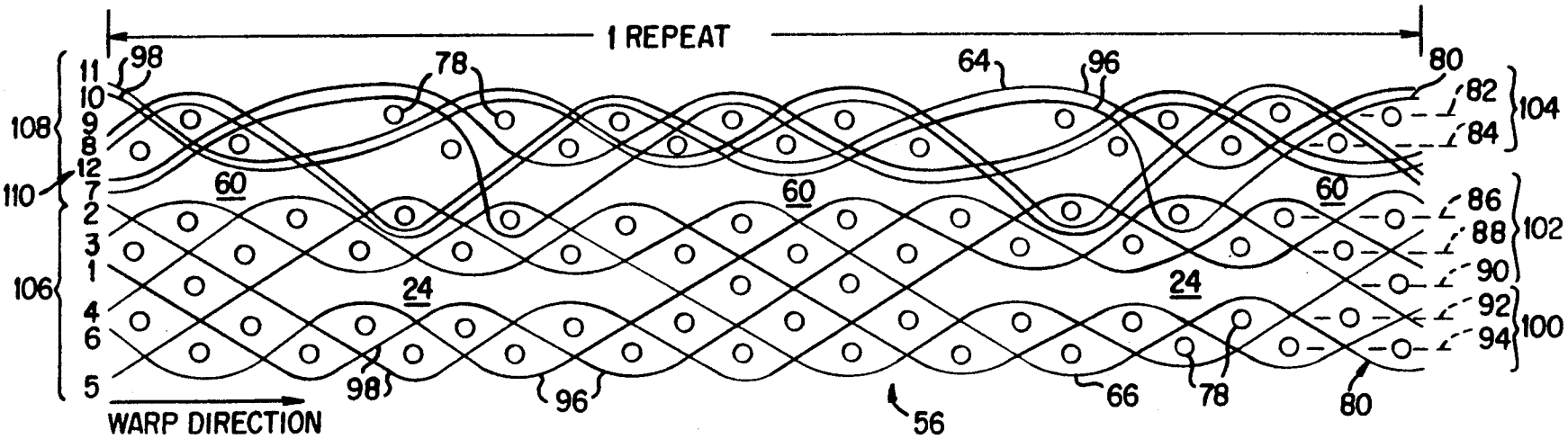
FIG. 7 is a schematic view in cross-sectional elevation of a portion of the fabric of FIG. 5 illustrating the details of the weave thereof.

FIG. 7 shows in detail the manner in which the fabric 56 of FIG. 5 is woven, in the present example. A first yarn system of the fabric 56 is comprised of a plurality of fill yarns 78 extending in generally parallel spaced-apart relation to one another along the length "l" of the fabric 56. The fill yarns 78 are arranged into a plurality of yarn layers 80 disposed in generally parallel, spaced-apart relation through the thickness "t" of the fabric 56 between the opposite top and bottom surfaces 64 and 66. As shown in FIG. 7 there are seven different ones 82, 84, 86, 88, 90, 92 and 94 of the yarn layers 80. The first two 82 and 84 of the yarn layers 80 are disposed between the top surface 64 of the fabric 56 and the slots 60. The remaining five ones 86, 88, 90, 92 and 94 of the yarn layers 80 lie beneath the slots 60 and correspond basically with the yarn layers 32, 34, 50, 52 and 54 of the fabric 10 of FIG. 4. The yarn layers 86 and 88 lie beneath the slots 60 and above the slots 24. The yarn layer 92 is disposed within the plane of the slots 24. The yarn layers 92 and 94 are disposed between the slots 24 and the bottom surface 66.

The fabric 56 also includes a second or weaver yarn system comprised of a plurality of warp yarns 96. The warp yarns 96 are arranged into a plurality of warp yarn layers 98 which alternately extend in zig-zag fashion through different portions of the thickness "t" of the fabric 56. There are 12 different ones of the warp yarn layers 98 which are numbered at the left hand end of FIG. 7.

The thickness "t" of the fabric 56 is divided into a first region 100 extending between the bottom surface 66 and the slots 24, a second region 102 extending between the slots 24 and the slots 60, and a third region 104 extending between the slots 60 and the top surface 64. Each of the three different regions 100, 102 and 104 of the thickness "t" of the fabric 56 includes a plurality of the fill yarn layers 80 therein.

The warp yarn layers 98 are divided into three different groups in terms of the thickness regions 100, 102 and 104 of the fabric 56 with which they interweave. A first such group 106 is comprised of the warp yarn layers numbered 1–6 at the left hand end of FIG. 7. The warp yarn layers 98 within such first group 106 extend through the first and second regions 100 and 102 of the thickness "t" of the fabric 56. The second group 108 of the warp yarn layers 98 is comprised of the layers numbered 7–11 at the left hand end of FIG. 7. These five layers extend between the second and third regions 102 and 104 of the thickness "t" of the fabric 56. A third group 110 of the warp yarn layers 98 comprises the single warp yarn layer numbered 12 at the left hand end of FIG. 7. The warp yarn layer 12 is confined to and interweaves with the fill yarn layers 80 within the third region 104 of the thickness "t" of the fabric 56.

FIG. 7 shows one repeat of the weaving process which forms the fabric 56. The repeat shown in FIG. 7 forms a portion of the fabric 56 which includes two of the slots and a full one and two halves of the upper slots 60. The single repeat shown requires 72 picks of a conventional loom, with each of the 72 picks being associated with a different one of the fill yarns 78 shown. As in the case of FIG. 4, the warp direction is labeled and illustrated in FIG. 7.

The structural members 42 and 72 shown in FIGS. 3 and 6 can be made of different materials as desired and are useful for a number of different applications. For example, the structural members 42 and 72 can be used as heat exchanger panels. In one such application, high pressure hydrogen is pumped through the cylindrical apertures 46 to facilitate the removal of heat from regions surrounding the exterior of the structural member. For such applications the warp yarns, and where desired the fill yarns, can be made of carbon or graphite yarns so as to provide high heat conductivity and thereby facilitate the removal of heat through the cylindrical apertures 46.

While there have been described above and illustrated in the drawings a number of variations, modifications and alternative forms, it will be appreciated that the scope of the invention defined by the appended claims includes all forms comprehended thereby.

What is claimed is:

1. An integrally woven multi-layer angle interlocked fabric having a width defined by the widths of opposite top and bottom surfaces and opposite end surfaces, the fabric having a cross-sectional elevation between the opposite top and bottom surfaces and the opposite end surfaces which is generally uniform across the width of the fabric, the fabric having a plurality of apertures therein which extend across the width of the fabric, the plurality of apertures being completely contained within the cross-sectional elevation and being spaced apart from the opposite top and bottom surfaces and the opposite end surfaces.

2. The invention set forth in claim 1, wherein the plurality of apertures are spaced apart along the cross-sectional elevation of the fabric between the opposite end surfaces.

3. The invention set forth in claim 2, wherein the plurality of apertures comprise slots in the fabric generally disposed within a common plane generally parallel to the opposite top and bottom surfaces.

4. The invention set forth in claim 2, further including a second plurality of apertures in the fabric which extend across the width of the fabric, at least some of the second plurality of apertures being completely contained within the cross-sectional elevation, the second plurality of apertures being spaced apart along the cross-sectional elevation of the fabric between the opposite side surfaces and being offset from and staggered relative to the first-mentioned plurality of apertures.

5. The invention set forth in claim 4, wherein the first-mentioned plurality of apertures comprise slots in the fabric generally disposed within a first common plane generally parallel to the opposite top and bottom surfaces and the second plurality of apertures comprise slots in the fabric generally disposed within a second common plane generally parallel to and spaced apart from the first common plane.

6. An integrally woven multi-layer angle interlocked fabric comprising a plurality of spaced apart, generally parallel cylindrical portions thereof having hollow, generally cylindrical interiors, the cylindrical portions being joined together by connecting portions lying generally within a common plane.

7. The invention set forth in claim 6, wherein the fabric is comprised of a first yarn system having a plurality of yarns extending across a width of the fabric as defined by a common direction of elongation of the cylindrical portions and the connecting portions and a second yarn system having a plurality of yarn layers which alternately extend through upper portions of alternate ones of the cylindrical portions and opposite lower portions of intervening ones of the cylindrical portions, the plurality of yarn layers of the second yarn system being comprised of yarns extending in directions generally transverse to the plurality of yarns of the first yarn system.

8. The invention set forth in claim 6, wherein the fabric further comprises a thin planar portion thereof disposed at the side of and joining each of the cylindrical portions, the planar portion being spaced apart from the connecting portions and forming a plurality of apertures with the connecting portions and adjoining portions of the cylindrical portions.

9. An integrally woven multi-layer angle interlocked fabric having a plurality of apertures therein completely contained within a cross-sectional elevation of the fabric so as to be spaced-apart from opposite top and bottom surfaces and opposite end surfaces of the fabric forming the perimeter of the cross-sectional elevation, the fabric being comprised of a first yarn system forming a plurality of yarn layers on each of opposite sides of the plurality of apertures and a second yarn system interwoven with each yarn layer of the plurality of yarn layers on each of opposite sides of the plurality of apertures.

10. The invention set forth in claim 9, wherein the second yarn system comprises a plurality of yarn layers repeatedly extending through at least a portion of a thickness of the fabric between the opposite top and bottom surfaces.

11. The invention set forth in claim 10, wherein at least some of the plurality of yarn layers of the second yarn system alternately extend between one of the opposite sides of the plurality of apertures at each of the plurality of apertures and the other one of the opposite sides of the plurality of apertures at an adjacent one of the plurality of apertures.

12. An integrally woven multi-layer angle interlocked fabric having a plurality of apertures therein completely contained within a cross-sectional elevation of the fabric so as to be spaced-apart from opposite top and bottom surfaces and opposite end surfaces of the fabric forming the perimeter of the cross-sectional elevation, the fabric being comprised of a first yarn system forming a plurality of yarn layers on a first side of the plurality of apertures and at least one yarn layer on an opposite second side of the plurality of apertures, and a second yarn system forming a plurality of yarn layers at least some of which are interwoven with each of the plurality of yarn layers on the first side of the plurality of apertures and with the at least one yarn layer on the opposite second side of the plurality of apertures.

13. An integrally woven multi-layer angle interlocked fabric having opposite top and bottom surfaces extending between opposite end surfaces, the fabric having a first plurality of apertures therein spaced apart between the opposite end surfaces and being adjacent and spaced-apart from the bottom surface and a second plurality of apertures therein spaced apart between the opposite end surfaces and being disposed between and spaced apart from the first plurality of apertures and the top surface.

14. The invention set forth in claim 13, wherein the fabric has a thickness between the opposite top and bottom surfaces which is comprised of a first region between the bottom surface and the first plurality of apertures, a second region between the first plurality of apertures and the second plurality of apertures, and a third region between the second plurality of apertures and the top surface, the fabric being comprised of a first yarn system forming a plurality of yarn layers within each of the first, second and third regions of the thickness of the fabric, and a second yarn system comprised of a first group of yarns alternately extending between and interweaving with the pluralities of yarn layers in the first and second regions, a second group of yarns alternately extending between and interweaving with the pluralities of yarn layers in the second and third regions, and a yarn interweaving with the pluralities of yarn layers in the third region.

15. The invention set forth in claim 14, wherein the first group of yarns comprises a plurality of yarn layers extending around and defining the first plurality of apertures together with the pluralities of yarn layers in the first and second regions, and the second group of yarns comprises a plurality of yarn layers extending around and defining the second plurality of apertures together with the pluralities of yarn layers in the second and third regions.

16. The invention set forth in claim 14, wherein the apertures of the first plurality of apertures are generally cylindrical in shape, the first and second regions of the thickness of the fabric combine with the first plurality of apertures to form a succession of hollow, generally cylindrical portions of the fabric, and the third region of the thickness of the fabric is a thin, generally planar configuration and adjoins top portions of the succession of hollow, generally cylindrical portions of the fabric between the apertures of the second plurality of apertures.

* * * * *